United States Patent [19]

Kimura et al.

[11] 4,265,780

[45] May 5, 1981

[54] PROCESS FOR CLEANING OF TIN-PLATED STEEL CANS

[75] Inventors: Masao Kimura; Tamotu Sobata; Hideo Wada, all of Neyagawa, Japan

[73] Assignee: Nippon Paint Co., Ltd., Japan

[21] Appl. No.: 119,776

[22] Filed: Feb. 8, 1980

[30] Foreign Application Priority Data

Feb. 15, 1979 [JP] Japan ..... 54-16834

[51] Int. Cl.[3] ..... C23G 1/14; C23G 1/18; C11D 7/06

[52] U.S. Cl. ..... 252/156; 134/40; 134/2; 252/174.16

[58] Field of Search ..... 134/2, 40; 252/156, 252/174.16

[56] References Cited

U.S. PATENT DOCUMENTS

| | | | |
|---|---|---|---|
| 2,739,942 | 3/1956 | Eckey | 252/132 |
| 2,748,035 | 5/1956 | Duncan | 134/2 |
| 2,836,566 | 5/1958 | Duncan | 134/2 X |
| 3,653,095 | 4/1972 | Dupre et al. | 134/2 X |
| 3,888,783 | 6/1975 | Rodzewich | 134/2 X |
| 3,895,910 | 7/1975 | Juchniewicz | 134/2 X |
| 4,094,701 | 6/1978 | Fekete | 134/40 X |
| 4,187,127 | 2/1980 | Yashiro et al. | 148/6.15 R |

FOREIGN PATENT DOCUMENTS

| | | |
|---|---|---|
| 1065306 | 9/1959 | Fed. Rep. of Germany . |
| 52-20599 | 9/1977 | Japan . |

*Primary Examiner*—Marc L. Caroff

*Attorney, Agent, or Firm*—Wenderoth, Lind & Ponack

[57] ABSTRACT

A process for cleaning of tin-plated steel cans which comprises washing the surface of a tin-plated steel can with an alkaline solution comprising at least one of esters of myoinositol with 2 to 6 molecules of phosphoric acid and their alkali metal salts, alkaline earth metal salts, ammonium salts and amine salts in a concentration of at least 0.05 g/l and having a pH of 8 to 13, whereby oils and fats adhering to the said surface as well as the oxide film formed on such surface are eliminated without dissolution or corrosion of tin and substrate iron.

2 Claims, No Drawings

PROCESS FOR CLEANING OF TIN-PLATED STEEL CANS

The present invention relates to a process for cleaning of tin-plated steel cans. More particularly, it relates to a process for cleaning of tin-plated steel cans which can efficiently eliminate oils and fats adhering to the surfaces of such cans and oxide films formed thereon and can prevent dissolution or corrosion of tin or substrate iron of such cans.

In tin-plated steel cans for foods and drinks, there is a tendency that conventional three-piece cans comprising a can trunk, a can lid and a can bottom are replaced by two-piece cans in which a can trunk and a can bottom are unified into one integral body under consideration of production costs and adequacy as food cans.

For preparation of such two-piece cans, a tin-plated steel sheet is punched into a circle plate, which is then cupped. The resulting cup is drawn, optionally followed by ironing so as to obtain an integral body for a can trunk and a can bottom. In such molding process, a lubricant comprising mineral oils, animal and vegetable oils, surface active agents, oiliness improvers and extreme pressure additives is employed for protecting the metal surfaces of the die and the can and for facilitating the operation of molding. After the molding, the surface of the thus obtained tin-plated steel can is subjected to cleaning and, if necessary, to anti-corrosive treatment, followed by paint-coating.

The cleaning is usually performed by alkali washing. But, on the can surface subjected to molding, metal soaps are formed by fatty acids contained in the lubricant to prevent the can surface from cleaning. When a strong alkaline builder is used and a high concentration and a high temperature are adopted in the alkali washing, cleaning can be achieved. However, such severe condition increases dissolution of tin on the can surface to deteriorate the appearance of the plated surface and to lower the anti-corrosive property markedly so that the resultant can becomes inadequate for a vessel for foods and drinks. In order to decrease the dissolution of tin, there has been proposed the use of an alkaline solution containing borax or a silicate, but its effect is still not satisfactory.

As the result of an extensive study on a cleaning process for tin-plated steel cans after the molding, it has been found that when an alkaline solution containing phytic acid or its derivative and having a specific pH value is used, the surfaces of such cans can be well cleaned with prevention of dissolution of tin. The present invention is based on the above finding.

According to the invention, there is provided a process for cleaning tin-plated steel cans which comprises washing the surface of a tin-plated steel can with an alkaline solution comprising at least one of esters of myoinositol with 2 to 6 molecules of phosphoric acid and theiprocess for cleaning tin-plated steel cans which comprises washing the surface of a tin-plated steel can with an alkaline solution comprising at least one of esters of myoinositol with 2 to 6 molecules of phosphoric acid and their alkali metal salts, alkaline earth metal salts, ammonium salts and amine salts in a concentration of at least 0.05 g/l and having a pH of 8 to 13.

As the alkaline solution, there may be used any conventional one comprising an alkaline builder in water which is, however, novel and characteristic in containing at least one of esters of myoinositol with 2 to 6 molecules of phosphoric acid and their alkali metal salts, alkaline earth metal salts, ammonium salts and amine salts in a concentration of at least 0.05 g/l and having a pH of 8 to 13.

Examples of the alkaline builder are sodium hydroxide, carbonates (e.g. soda ash), bicarbonates (e.g. sodium bicarbonate), silicates (e.g. sodium metasilicate), phosphates (e.g. sodium secondary phosphate, sodium tertiary phosphate), condensed phosphates (e.g. sodium tripolyphosphate), etc. They may be used solely or in combination. In respect of the cleaning activity, phosphates, condensed phosphates, silicates and sodium hydroxide are preferable. From the view point of prevention of dissolution of tin from the tin-plated steel can, carbonates, bicarbonates and borax are favorable. The alkaline builder is used in a concentration which affords a sufficient cleaning effect. With an excessive concentration, the problem of dissolution of tin arises particularly in case of a strongly alkaline builder (e.g. sodium hydroxide, sodium tertiary phosphate). Usually, a concentration of 1 to 50 g/l is desirable. In addition, a surface active agent having a cleaning activity or a defoaming activity may be incorporated in a suitable amount so as to increase the cleaning effect.

The esters of myoinositol with 2 to 6 molecules of phosphoric acid may be, for instance, myoinositol diphosphate, myoinositol triphosphate, myoinositol tetraphosphate, myoinositol pentaphosphate or myoinositol hexaphosphate. Among them, the ester with 6 molecules of phosphoric acid corresponds to "phytic acid", which is contained in various kinds of plants including grains such as rice, barley, soybean and corn. This is a quite harmless substance and has been employed in the canning industry as an additive for prevention of discoloration of canned foods and of smelling and corrosion of cans. The esters with 2 to 5 molecules of phosphoric acid are partially hydrolyzed products of phytic acid. The phytic acid and its hydrolyzed products may be employed in the form of various salts such as alkali metal salts (e.g. sodium salt, potassium salt), alkaline earth metal salts (e.g. calcium salt, magnesium salt, barium salt), ammonium salt and amine salts. The phytic acid, its hydrolyzed products and their salts are hereinafter referred to as "phytic acid compounds".

The concentration of the phytic acid compound may be at least 0.05 g, preferably from 0.05 to 50 g, per 1 liter of the alkaline solution. When the concentration is less than 0.05 g/l, a sufficient effect for prevention of dissolution of tin is not expected. Even when the concentration becomes larger than 50 g/l, a further increase of the effect is not attained. By the use of the phytic acid compound, a tin phytate film is formed on the can surface, and the rust-resistance after cleaning, the paint-adherence and the corrosion-resistance are improved.

In addition to the above components, the alkaline solution may comprise other conventional additives for various purposes insofar as the cleaning effect and the tin dissolution-preventing effect are not unfavorably influenced.

In the alkaline solution of the invention, it is important to maintain the pH value at 8 to 13. When the pH value is smaller than 8, a sufficient cleaning effect is not obtained. When the pH value exceeds 13, an excessive amount of tin is dissolved, and the substrate iron is exposed so that the can appearance is deteriorated and the corrosion-resistance is reduced.

In the process of the invention, the cleaning is usually carried out at a temperature of 40° to 80° C. by a conventional appropriate procedure such as immersion or spraying depending on the form of the can. In usual, spraying is preferable. The spraying time may be from 30 seconds to 2 minutes.

The present invention will be hereinafter explained further in detail by the following Examples and Comparative Examples.

EXAMPLES 1 TO 6 AND COMPARATIVE EXAMPLES 1 TO 4

A tin-plated steel can body (amount of plated tin, 11.2 g/m$^2$ on one surface) obtained by the DI molding process was washed by spraying thereto a base cleaning solution as shown below (Nos. 1 to 4) incorporated or not with phytic acid under the following conditions: temperature, 50°–70° C.; spraying time, 50 seconds; spraying pressure, 3 kg/cm$^2$. The resultant can was subjected to the test for cleaning efficiency and to the aqueous sodium chloride-immersion test.

Using the same can and the same washing solution as above, cleaning was effected under the same conditions as above but adopting a spraying time of 20 minutes instead of 50 seconds, and the amount of corrosion per each can (surface area: about 470 cm$^2$) was calculated from the difference of the weights of the can (mg/can) before and after spraying.

| Base cleaning solution No. 1 | (g/l) |
|---|---|
| Soda ash | 4.5 |
| Sodium tertiary phosphate | 4.5 |
| "Emulgen 910" (surface active agent manufactured by Kao Atlas Co., Ltd.) | 0.5 |
| "Purlonick L-61" (surface active agent manufactured by Asahi Denka Kogyo K.K.) | 0.5 |
| **Base cleaning solution No. 2** | **(g/l)** |
| Sodium metasilicate | 1.5 |
| Soda ash | 0.5 |
| Sodium bicarbonate | 0.5 |
| Sodium tripolyphosphate | 1.0 |
| "Surfonic LF 17" (surface active agent manufactured by Jefferson Chemical Corp.) | 0.2 |
| **Base cleaning solution No. 3** | **(g/l)** |
| Sodium metasilicate | 4.0 |
| Soda ash | 2.0 |

-continued

| | |
|---|---|
| Sodium bicarbonate | 2.0 |
| Sodium tripolyphosphate | 3.0 |
| "Surfonic LF 17" | 0.5 |
| **Base cleaning solution No. 4** | **(g/l)** |
| Sodium bicarbonate | 6.0 |
| Sodium tertiary phosphate | 1.0 |
| Sodium secondary phosphate | 1.0 |
| "Emulgen 910" | 0.4 |
| "Purlonick L-61" | 0.2 |

Test for cleaning efficiency

The can subjected to cleaning was immediately washed with water and allowed to stand at room temperature for 90 seconds, and the cleaning efficiency was evaluated by the wettability (%) on the can surface calculated according to the following equation:

$$\text{Wettability (\%)} = \frac{\text{Surface area wetted with water}}{\text{Total surface area}} \times 100$$

Aqueous sodium chloride-immersion test

The can subjected to cleaning was immersed into a 5% (w/v) aqueous sodium chloride solution at 25° C. for 30 minutes, and the appearance of the can surface was observed:

⊙: No abnormality observed.

○: Partial rusting observed.

x: Considerable amount of rust observed.

The results of these tests are shown in Table 1.

TABLE 1

| | Alkaline washing solution | | | Washing | Test for cleaning | Aqueous sodium | Amount of corrosion after spraying |
|---|---|---|---|---|---|---|---|
| | Base cleaning solution | Amount of phytic acid added (g/l) | pH | temperature (°C.) | efficiency Wettability (%) | chloride-immersion test | for 20 minutes (mg/can) |
| Example 1 | No. 1 | 1 | 10.1 | 50 | 98–100 | ○ | 52 |
| Example 2 | | 2 | 10.1 | 50 | 98–100 | ○ | 24 |
| Comparative Example 1 | | 0 | 10.1 | 50 | 98–100 | X | 158 |
| Example 3 | No. 2 | 1 | 10.0 | 70 | 98–100 | ⊙ | 2 |
| Comparative Example 2 | | 0 | 10.0 | 70 | 98–100 | X | 85 |
| Example 4 | No. 3 | 0.5 | 11.0 | 50 | 98–100 | | 3 |
| Example 5 | | 1 | 11.0 | 50 | 98–100 | ⊙ | 2 |
| Comparative Example 3 | | 0 | 11.0 | 50 | 98–100 | ⊙ | 27 |
| Example 6 | No. 4 | 1 | 9.7 | 60 | 95–98 | ⊙ | 10 |
| Comparative Example 4 | | 0 | 9.7 | 60 | 95–98 | ○ | 34 |

What is claimed is:

1. A process for cleaning a tin-plated steel can by washing its surface with an alkaline solution comprising an alkaline builder in an amount sufficient to clean the surface, wherein the alkaline solution additionally comprises at least one of esters of myoinositol with 2 to 6 molecules of phosphoric acid and their alkali metal salts, alkaline earth metal salts, ammonium salts and amine salts in a concentration of not lower than 0.05 g/l and has a pH of 8 to 13.

2. The process according to claim 1, wherein the alkaline solution comprises at least one of esters of myoinositol with 2 to 6 molecules of phosphoric acid and their alkali metal salts, alkaline earth metal salts, ammonium salts and amine salts in a concentration of not higher than 50 g/l.

* * * * *